US008777569B1

(12) United States Patent
Liang

(10) Patent No.: US 8,777,569 B1
(45) Date of Patent: Jul. 15, 2014

(54) TURBINE VANE WITH IMPINGEMENT COOLING INSERT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 673 days.

(21) Appl. No.: 13/049,371

(22) Filed: Mar. 16, 2011

(51) Int. Cl.
*F01D 5/08* (2006.01)
*F01D 5/18* (2006.01)

(52) U.S. Cl.
USPC ..... 416/96 A

(58) Field of Classification Search
CPC ..... F01D 5/18; F01D 5/187; F01D 5/188; F01D 5/189; F05D 2260/201
USPC ..... 416/96 R, 97 R, 97 A, 96 A, 95; 415/115
See application file for complete search history.

(56) References Cited

U.S. PATENT DOCUMENTS

| | | | | |
|---|---|---|---|---|
| 4,359,310 | A * | 11/1982 | Endres et al. | 415/115 |
| 5,704,763 | A * | 1/1998 | Lee | 416/96 R |
| 2003/0049127 | A1 * | 3/2003 | Tiemann | 416/97 R |
| 2005/0232769 | A1 * | 10/2005 | Lee et al. | 416/97 R |
| 2008/0260537 | A1 * | 10/2008 | Lang | 416/96 R |
| 2010/0068034 | A1 * | 3/2010 | Schiavo et al. | 415/115 |

* cited by examiner

*Primary Examiner* — Ned Landrum
*Assistant Examiner* — Ryan Ellis
(74) *Attorney, Agent, or Firm* — John Ryznic

(57) ABSTRACT

A turbine stator vane with cooling air cavities each having an impingement cooling insert secured therein, and an impingement cooling insert secured within each cavity. A leading edge impingement insert and a mid-chord impingement insert have a section on the pressure side wall with impingement holes forming a parallel flow of impingement cooling air and a section on the suction side wall with a sinusoidal shaped piece that forms a series of impingement cooling holes that produces impingement cooling on cooler surfaces of the airfoil but with less cooling air flow.

1 Claim, 3 Drawing Sheets

TURBINE VANE WITH IMPINGEMENT COOLING INSERT

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to an industrial turbine stator vane with an impingement cooling insert for cooling.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

A first stage turbine stator vane with an insert for producing impingement cooling is shown in FIG. 1. The vane includes an airfoil 10 with ribs extending across the pressure side wall to the suction side wall to form in this case three impingement cooling air cavities 11, 12 and 13. Each impingement cavity includes an impingement cooling insert with an arrangement of impingement cooling holes 17 directed to discharge impingement cooling air to the backside surfaces of the airfoil walls. A leading edge insert 14 is secured in the leading edge cavity 11, a mid-chord insert 15 is secured within the mid-chord cavity 12, and a trailing edge region insert 16 is secured within the third or trailing edge cavity 13. A showerhead arrangement of film cooling holes 19 are located in the leading edge region of the airfoil, a row of trailing edge exit holes 18 in the trailing edge, and rows of film cooling holes 21 are located on the pressure and suction side walls to discharge film cooling air.

The vane cooling circuit of FIG. 1 works like this. Cooling air supplied to the vane flows into the three cooling air cavities 11-13 and then through the impingement holes 17 formed in the inserts 14-16 to produce impingement cooling on the backside surface of the airfoil walls. The spent impingement cooling air then flows through the film cooling holes spaced around the airfoil surface or out through the exit holes in the trailing edge of the airfoil.

BRIEF SUMMARY OF THE INVENTION

A turbine stator vane with impingement cooling inserts located within cooling air cavities in the vane. The cooler suction side walls are cooled by an insert that forms a sinusoidal shape with a series of impingement cooling holes that form a series flow of impingement cooling along cooler surfaces of the airfoil walls. The hotter sides of the pressure side wall are cooled using the prior art insert with parallel impingement cooling holes formed in the insert. With this design, less cooling air is required for impingement cooling along the cooler surfaces of the airfoil walls located along the suction side wall and in the trailing edge region on both sides walls.

DETAILED DESCRIPTION OF THE INVENTION

Figure 1:
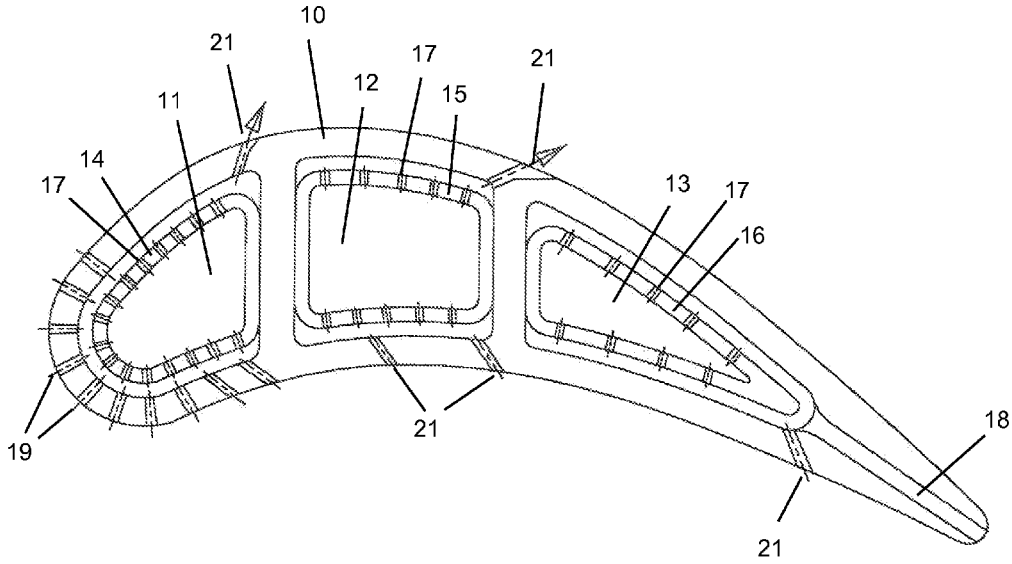
FIG 1 prior art
FIG. 1 shows a cross section view of a first stage industrial stator vane cooling circuit of the prior art with impingement inserts located within cooling air cavities.
Figure 2:
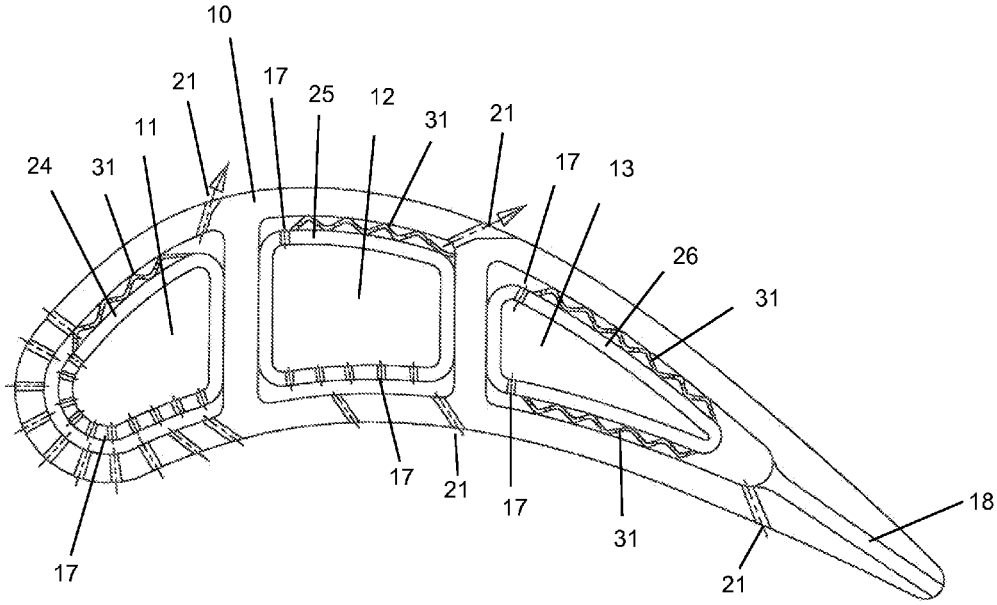
FIG. 2 shows a cross section view of a stator vane cooling circuit with wavy shaped impingement cooling inserts of the present invention.
Figure 3:
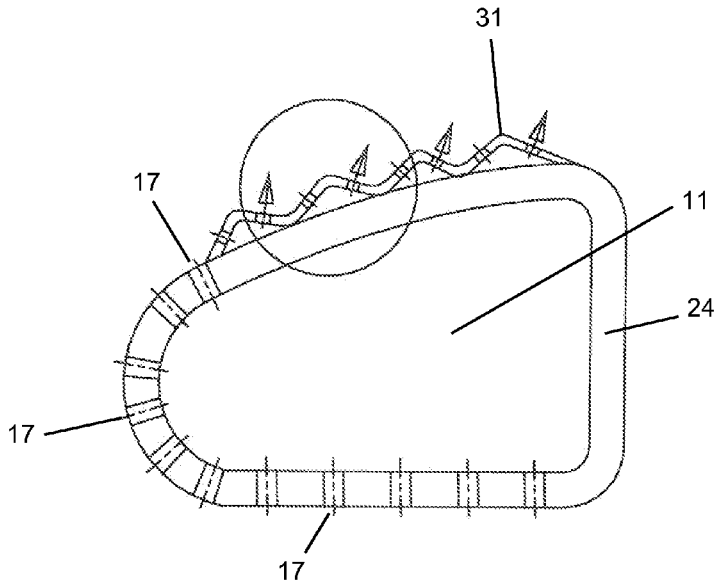
FIG. 3 shows a detailed cross section view of the leading edge impingement cooling insert of the present invention.
Figure 4:
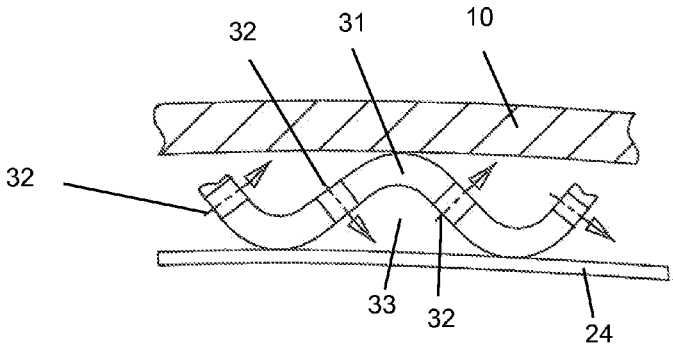
FIG. 4 shows a detailed view of a section of the leading edge impingement cooling insert of FIG. 3.

A stator vane for a turbine in a gas turbine engine is shown in FIGS. 2 through 4 and is intended to be used in a first stage vane of a large industrial gas turbine engine but could be used in other engines. In the prior art vane with impingement inserts of FIG. 1, all sides of the airfoil of the vane are cooled with an insert that includes rows of impingement holes in parallel with one another. The pressure side wall and the suction side wall are cooled by discharging impingement cooling air through impingement cooling holes 17 against a backside surface of the walls. The applicant has discovered that the suction side wall is exposed to lower gas stream temperatures than the pressure side wall and thus does not require the amount of impingement cooling air that is discharged onto the backside surface of the suction side wall. Thus, in the applicant's invention the suction side wall is cooled using a series of impingement cooling holes instead of the parallel impingement cooling of FIG. 1. This is shown by a section of the insert up against the suction side wall that has a sinusoidal cross section shape as seen in FIG. 2.

FIG. 2 shows the vane with an insert having a combination of parallel impingement cooling and series impingement cooling. The vane is divided up into three impingement cavities 11-13 like in the prior art FIG. 1, but with different shaped inserts. The leading edge cavity 11 includes a leading edge insert 24 with impingement cooling holes 17 spaced along the pressure side wall and the leading edge region for parallel flow of the cooling air and a sinusoidal shaped section 31 to produce a series of impingement cooling on the backside surface of the suction side wall along this section of the airfoil.

FIG. 3 shows a detailed view of the leading edge region insert 24 with the sinusoidal shaped section 31 that extends along the suction side wall portion of the insert 24 with cooling holes to form a series flow from one end of the sinusoidal shaped section 31 to the other end. The cooling air flows out from an adjacent impingement hole 17 and then through the hole in the forward end of the sinusoidal shaped insert 31, and then through the next hole that is directed to discharge the cooling air against the backside surface of the suction side wall. This series of cooling air flow will produce impingement cooling of the backside surface of the suction side wall along this section of the wall using the same cooling air flow. This is different than the parallel flow of impingement cooling air that occurs on the pressure side and the leading edge region of the insert 24 in which cooling air from the impingement cavity 11 flows through individual impingement holes 17 in parallel such that the cooling air from one impingement hole 17 does not flow through another impingement hole 17.

As seen in FIG. 2, the spent impingement cooling air from the impingement holes 17 in the leading edge cavity 11 will flow through the film cooling holes 19 spaced around the pressure side wall and the leading edge region of the airfoil or through the series of impingement cooling holes in the sinusoidal shaped insert 31 before flowing out through the row of film cooling holes 21 downstream from the sinusoidal shaped insert 24. FIG. 4 shows a detailed view of a section of the sinusoidal shaped section 31 of the insert 24 with the series flowing impingement cooling holes 32 that alternate between inward flowing and outward flowing in which the outward flowing holes produce impingement cooling of the backside surface of the airfoil wall. Spent impingement air return compartments 33 are formed between the regular insert 24 and the sinusoidal shaped section 31. With this design, less cooling air flow is required for this cooler section along the suction side wall than in the FIG. 1 prior art design.

The mid-chord cavity 12 also includes an insert 25 with a sinusoidal shaped section 31 along the suction side wall to produce series impingement cooling through holes 32 instead of the parallel impingement cooling formed on the opposite side for the pressure side wall. An impingement cooling hole discharges cooling air from the cavity 12 forward from the sinusoidal shaped insert 31 that then flows through the series of impingement cooling holes 32 formed within the sinusoidal shaped insert 31 to produce a series flow of impingement cooling for this section of the suction side wall before being discharged out through a row of film cooling holes located aft of the insert 25 out from the suction side wall. The pressure side wall for the mid-chord insert 25 is cooled using the parallel flow of impingement cooling through the holes 17. Two rows of film cooling holes discharge the spent impingement cooling air out from the pressure side wall.

The trailing edge insert 26 includes a sinusoidal shaped section 31 along the pressure side wall and the suction side wall because the pressure side wall in the trailing edge region is not exposed to the higher gas stream temperatures and can be cooled using less cooling air flow. Both the pressure side and the suction side of the T/E insert 26 includes a sinusoidal shaped insert 31 that forms the series flow of impingement cooling air through holes 32 for the backside surfaces of the P/S and S/S walls in the trailing edge region. The spent impingement cooling air is then discharged through a row of T/E exit holes 18 or a row of film cooling holes 21 on the P/S wall aft of the insert 26.

For the cooling flow control, by regulating the impingement pressure ratio across the metering and impingement cooling holes, each individual cavity can be designed based on airfoil gas side pressure distribution in both chordwise and spanwise directions. In addition, each individual cavity can be designed based on the airfoil local external heat load to achieve a desire local metal temperature. With this unique cooling construction approach, a maximum use of the cooling air for a given airfoil inlet gas temperature and pressure profile is achieved. In addition, the multi-metering and diffusion cooling construction utilizes the multi-hole impingement cooling technique for the backside convective cooling as well as flow metering purpose and the spent cooling air can be discharged onto the airfoil surface at desirable mass flux ratio thus achieve a very high film effectiveness.

In operation, the cooling air is supplied through the airfoil leading edge impingement cavity 11, impinged onto the inner surface of the airfoil leading edge region where the external heat load is the highest. A small portion of the spent cooling air can be discharged through the leading edge showerheads to provide film cooling for the airfoil leading edge region. The spent cooling air is then impinged onto the airfoil suction side inner surface again from the leading edge impingement cavity 11. The spent cooling air is then bled into the collector chamber and then impinged onto the airfoil suction side inner surface again. Subsequently the spent cooling flows into a collector chamber (formed between the sinusoidal shaped insert section and the regular insert) and then impinged onto the airfoil suction side inner surface. This process of multiple impingement and flow into the collector cavity is repeated along the entire length of airfoil suction sides. This impingement process fully utilized the pressure potential between the cooling supply pressures to gas side main stream pressure for the cooling purpose. The spent cooling air is finally ejected through the airfoil wall film cooling holes to form a film cooling layer for the downstream surface.

This unique insert tube construction arrangement provides for the use of multi-impingement cooling with the concentrated cooling air for the turbine airfoil suction surface and/or trailing edge region, and a maximum usage of cooling air for a given airfoil inlet gas temperature and pressure profile is achieved. In addition, the use of total cooling for repeating impingement cooling in the series flow of impingement cooling holes generates extremely high turbulence level for a fix amount of coolant flow thus creating high value of internal heat transfer coefficient. As a result, the series flow and parallel flow inserts of the present invention yields higher internal convective cooling effectiveness than the traditional single pass impingement used in the prior art FIG. 1 turbine airfoil cooling design. The end results of this construction and cooling technique achieve a balanced life blade design at reduced blade cooling flow requirement.

Major advantages of this multi-impingement chamber construction concept over the conventional pin-fin cooling channel design are enumerated below. (1) The basic airfoil cooling concept consists of a series of impingement cavities with multi-impingement for the airfoil suction surface and single straight through impingement for the LE and pressure side surface. Individual impingement cavity can be designed for tailoring of the airfoil external heat load onto each individual section of the turbine airfoil. (2) For the suction side and third cavity insert tube, internal cooling impingement jet velocity and heat transfer performance for each individual impingement cavity is controlled by the spacing of the convective cavity for maintaining jet arrival velocity. Since a single row impingement cooling technique is utilized for each individual impingement cavity thus eliminates the cross flow effect on impingement jet velocity within the impingement cavity. (3) For the suction side and third cavity insert tube, individual multi-impingement cavities are communicated to each other in series and are designed based on the airfoil external heat load and cooling air discharge pressure onto the airfoil suction sides. (4) Concentrated cooling air is used for the impingement to each individual impingement cavity thus yields higher level of internal impingement heat transfer performance than the traditional impingement cooling which is subdivided the total cooling air throughout the entire airfoil inner surface. 5) The multi-impingement construction arrangement of the present invention enables to utilize the concentrated cooling air for repeating impingement cooling process.

I claim:

1. A turbine stator vane comprising:

a first impingement cavity located in a leading edge region of an airfoil of the vane;

a second impingement cavity located in a mid-chord region of the airfoil;

a third impingement cavity located in a trailing edge region of the airfoil;

a first insert secured within the first impingement cavity;

the first insert having impingement cooling holes spaced along a pressure side surface and a leading edge surface that discharge impingement cooling air in a parallel flow path against a pressure side wall and a leading edge wall;

the first insert having a sinusoidal shaped piece on a suction side surface with impingement cooling holes that form a series flow of impingement cooling air for a suction side wall of the airfoil;

a second insert secured within the second impingement cavity, the second insert having impingement cooling holes spaced along a pressure side surface that discharge impingement cooling air in a parallel flow path against a pressure side wall;

the second insert having a sinusoidal shaped piece on the suction side surface with impingement cooling holes that form a series flow of impingement cooling air for the suction side wall of the airfoil;

a third insert secured within the third impingement cavity;

the third insert having a sinusoidal shaped piece on a suction side surface and a pressure side surface with impingement cooling holes that form a series flow of impingement cooling air for the suction side wall and the pressure side wall of the airfoil;

a first row of film cooling holes on the suction side wall of the airfoil and connected to the first impingement cavity downstream from the series flow of impingement cooling air;

a second row of film cooling holes connected to the second impingement cavity downstream from the series flow of impingement cooling air; and, a row of exit holes along the trailing edge of the airfoil connected to the third impingement cavity.

* * * * *